US011166541B2

(12) United States Patent
Lin

(10) Patent No.: US 11,166,541 B2
(45) Date of Patent: Nov. 9, 2021

(54) STRAP-TYPE ELASTIC PHONE-HAND CONNECTOR

(71) Applicant: FRUITSHOP INTERNATIONAL CO., LTD., Zhonghe (TW)

(72) Inventor: Chin-Sheng Lin, Zhonghe (TW)

(73) Assignee: FRUITSHOP INTERNATIONAL CO., LTD., New Taipei (TW)

( * ) Notice: Subject to any disclaimer, the term of this patent is extended or adjusted under 35 U.S.C. 154(b) by 0 days.

(21) Appl. No.: 16/874,214

(22) Filed: May 14, 2020

(65) Prior Publication Data

US 2021/0298463 A1 Sep. 30, 2021

(30) Foreign Application Priority Data

Mar. 24, 2020 (TW) ..... 109203358

(51) Int. Cl.
*A45F 5/10* (2006.01)

(52) U.S. Cl.
CPC ..... *A45F 5/10* (2013.01); *A45F 2005/1013* (2013.01); *A45F 2200/0516* (2013.01)

(58) Field of Classification Search
CPC ..... A45F 5/10; A45F 2005/1013; A45F 2200/0516
USPC ..... 224/218
See application file for complete search history.

(56) References Cited

U.S. PATENT DOCUMENTS

| | | | | |
|---|---|---|---|---|
| 7,191,926 | B1 * | 3/2007 | Costantino | A45C 3/02 190/102 |
| 7,296,752 | B2 * | 11/2007 | Carnevali | G06F 1/163 235/462.43 |
| D650,531 | S * | 12/2011 | Young | D29/120.1 |
| D673,162 | S * | 12/2012 | Young | D14/447 |
| D679,693 | S * | 4/2013 | Rashid | D14/250 |
| 8,827,234 | B2 * | 9/2014 | Baker | G06F 1/1626 248/682 |
| 9,587,783 | B2 * | 3/2017 | Kofler | F16M 13/022 |
| 10,617,198 | B1 * | 4/2020 | De Michele | A45F 5/00 |
| D892,491 | S * | 8/2020 | Feng | D3/201 |
| 2005/0045681 | A1 * | 3/2005 | Hancock | B60R 11/0205 224/401 |
| 2007/0205236 | A1 * | 9/2007 | Partusch | A45F 3/02 224/250 |

(Continued)

*Primary Examiner* — Peter N Helvey
(74) *Attorney, Agent, or Firm* — Muncy, Geissler, Olds & Lowe, P.C.

(57) ABSTRACT

A strap-type elastic phone-hand connector, for fixedly wrapping a central-lens-type or corner-lens-type mobile device, includes an elastic main body and a fixation structure. The elastic main body includes first and second strap units. The first strap unit, located at a side of the elastic main body, forms two neighboring first accommodation holes. The second strap unit, connecting the first strap unit and located at another side of the elastic main body, forms a central hole and two opposing second accommodation holes. The fixation structure, connecting the elastic main body, is used for defining a penetration space for allowing part of a hand to penetrate through. With the first accommodation hole and the central hole to expose a corner lens assembly and a central lens assembly, this invention can be commonly used for both the corner-lens-type mobile device and the central-lens-type mobile device, respectively, without shading the lens assembly.

11 Claims, 12 Drawing Sheets

(56) References Cited

U.S. PATENT DOCUMENTS

| | | | | |
|---|---|---|---|---|
| 2010/0294908 | A1* | 11/2010 | Mish | A47B 23/043 248/451 |
| 2011/0303709 | A1* | 12/2011 | Wizikowski | F16M 13/04 224/218 |
| 2012/0024917 | A1* | 2/2012 | Case | A45F 5/021 224/259 |
| 2012/0200102 | A1* | 8/2012 | McMeans | A45F 5/00 294/149 |
| 2015/0249730 | A1* | 9/2015 | Larsen | H04M 1/05 29/428 |
| 2015/0288406 | A1* | 10/2015 | Haymond | A45C 13/30 455/575.6 |
| 2017/0120980 | A1* | 5/2017 | Karl | B62J 45/10 |

* cited by examiner

STRAP-TYPE ELASTIC PHONE-HAND CONNECTOR

This application claims the benefit of Taiwan Patent Application Serial No. 109203358, filed Mar. 24, 2020, the subject matter of which is incorporated herein by reference.

BACKGROUND OF THE INVENTION

(1) Field of the Invention

The invention relates to a strap application, and more particularly to a strap-type elastic phone-hand connector.

(2) Description of the Prior Art

With the rise of sports awareness and the development of smart phones, more and more people in exercise get used to carry a smartphone. The smartphone can be used for recording exercise details, computing exercise time or broadcasting musics. Nevertheless, exercise with the smartphone may cause some inconvenience. Further, a risk of smartphone slipping may be met due to sweating.

In addition, in the art, some sport accessories may provide a space for arranging the smartphone to some particular part of user's body such as an arm, a leg and a waist. However, these sport accessories are not suitable to all kinds of smartphone. For example, if a central-lens-type smartphone (having a built-in lens assembly disposed close to a center of the smartphone) is used, then a corresponding sport accessory suitable for this type of smartphone shall be bought. If the smartphone is changed to a corner-lens-type one in a later time (having the built-in lens assembly disposed close to a corner of the smartphone), then the former sport accessory would be ill-matched, and thus another purchase for a new sport accessory to meet the new corner-lens-type smartphone will be necessary. Accordingly, it is obvious that improvement at this manifold is definitely in demand.

SUMMARY OF THE INVENTION

In view that the conventional design for exercising with a smartphone may meet the risk of phone slipping and the expense waste in repurchasing another singular sport accessory for a specific type of smartphone, accordingly it is an object of the present invention to provide a strap-type elastic phone-hand connector that can resolve at least one of the aforesaid shortcomings in the art.

In this invention, the strap-type elastic phone-hand connector, applied for selectively and fixedly wrapping a central-lens-type mobile device or a corner-lens-type mobile device, includes an elastic main body and a fixation structure. The elastic main body, used for elastically and fixedly wrapping the central-lens-type mobile device or the corner-lens-type mobile device, includes a first strap unit and a second strap unit.

The first strap unit, located at a first side of the elastic main body, forms thereof two neighboring first accommodation holes. The second strap unit, connected with the first strap unit and located at a second side of the elastic main body by opposing to the first side, forms a central hole and two opposing second accommodation holes with respect to the central hole. The fixation structure, connected with the elastic main body, is used for defining a penetration space thereunder for allowing at least part of a hand to penetrate therethrough.

When the strap-type elastic phone-hand connector is utilized to fixedly wrap the central-lens-type mobile device, a central lens assembly of the central-lens-type mobile device is exposed through the central hole, and the two first accommodation holes and the two second accommodation holes hook four corner portion of the central-lens-type mobile device. When the strap-type elastic phone-hand connector is utilized to fixedly wrap the corner-lens-type mobile device, a corner lens assembly of the corner-lens-type mobile device is exposed to one of the two first accommodation holes, and the two first accommodation holes and the two second accommodation holes hook four corner portions of the corner-lens-type mobile device.

In one embodiment of the present invention, the first strap unit includes a first strap, a second strap and a third strap. The second strap is connected with the first strap to form one of the two first accommodation holes. The third strap is connected with the first strap to form another one of the two first accommodation holes.

In one embodiment of the present invention, the second strap unit includes a fourth strap, a fifth strap and a sixth strap. The fourth strap forms the central hole. The fifth strap is connected with the fourth strap to form one of the two second accommodation hole. The sixth strap is connected with the fourth strap to form another one of the two second accommodation holes.

In one embodiment of the present invention, the fixation structure includes a central fixed portion, a seventh strap, an eighth strap, a ninth strap and a tenth strap. The seventh strap is connected with the central fixed portion and the first strap unit, and located at the first side. The eighth strap is connected with the central fixed portion and the first strap unit, located at the first side. The ninth strap is connected with the central fixed portion and the second strap unit, and located at the second side. The tenth strap is connected with the central fixed portion and the second strap unit, and located at the second side.

In one embodiment of the present invention, the central fixed portion is furnished with at least one air vent.

In one embodiment of the present invention, the fixation structure is furnished with at least one through hole.

In one embodiment of the present invention, the strap-type elastic phone-hand connector further includes a central connected structure connected with the elastic main body and the fixation structure.

In one embodiment of the present invention, the strap-type elastic phone-hand connector is a symmetrical structure with respect to a reference center line.

In one embodiment of the present invention, the elastic main body is integrated with the fixation structure as a unique piece.

In one embodiment of the present invention, the first strap unit further forms a first object-connecting hole.

In one embodiment of the present invention, the second strap unit further forms a second object-connecting hole.

As stated, the strap-type elastic phone-hand connector provided by this invention utilizes the first strap unit and the second strap unit to fixedly wrap the central-lens-type mobile device or the corner-lens-type mobile device by relevantly skipping off the corner lens assembly or the central lens assembly. In comparison with the prior art, the connector of this invention can be commonly applied to different kinds of smartphone, without shading the lens assembly, but with the minimum risk in slipping the smartphone. In addition, the strap-type elastic phone-hand connector further introduces the through holes or the air vents for ventilation, such that possible sultry feeling at user's hand can be substantially reduced.

All these objects are achieved by the strap-type elastic phone-hand connector described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a strap-type elastic phone-hand connector. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
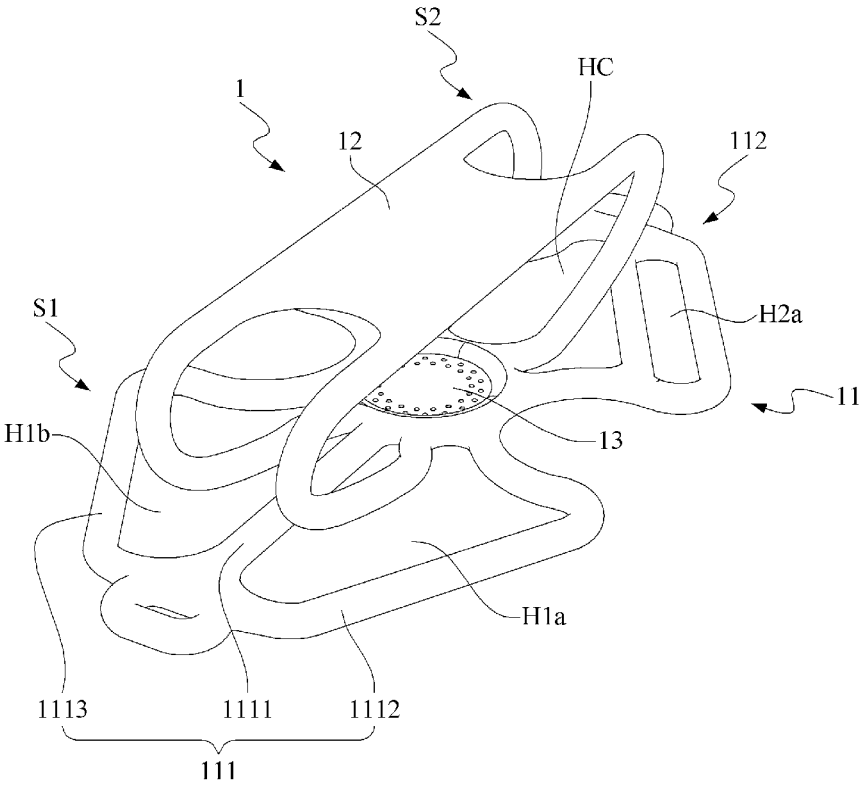
FIG. 1 is a schematic perspective view of a first embodiment of the strap-type elastic phone-hand connector in accordance with the present invention.
Figure 2:
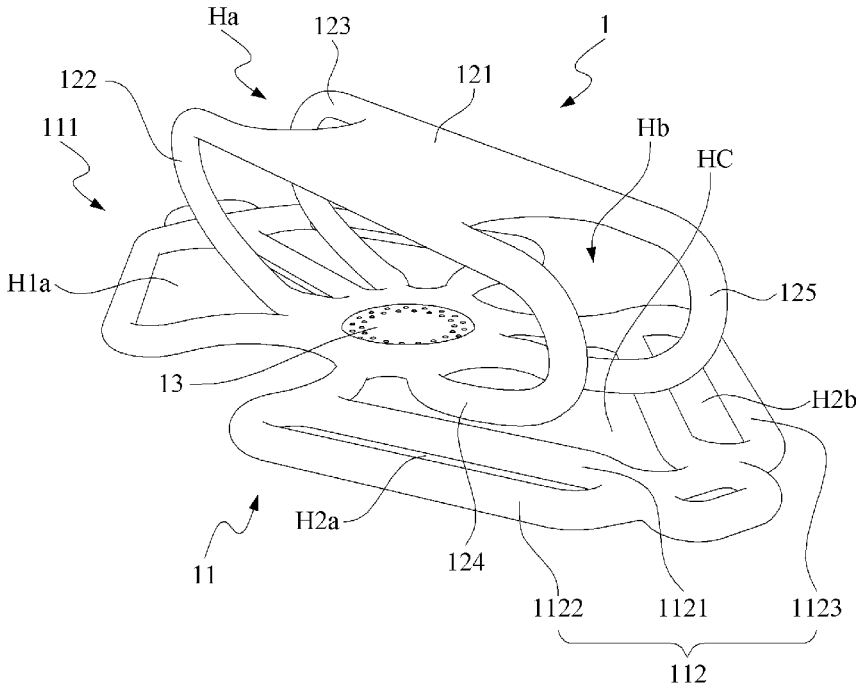
FIG. 2 shows schematically another view of FIG. 1.

Refer to FIG. 1 and FIG. 2; where FIG. 1 is a schematic perspective view of a first embodiment of the strap-type elastic phone-hand connector in accordance with the present invention, and FIG. 2 shows schematically another view of FIG. 1. As shown, the strap-type elastic phone-hand connector 1 includes an elastic main body 11, a fixation structure 12 and a central connected structure 13. The elastic main body 11 includes a first strap unit 111 and a second strap unit 112.

The first strap unit 111, located at a first side S1 of the elastic main body 11, includes a first strap 1111, a second strap 1112 and a third strap 1113. The second strap 1112 connects the first strap 1111 to form a first accommodation hole H1*a*, while the third strap 1113 connects the first strap 1111 to form another first accommodation hole H1*b*.

The second strap unit 112, connected with the first strap unit 111 and located at a second side S2 of the elastic main body 11, includes a fourth strap 1121, a fifth strap 1122 and a sixth strap 1123. The fourth strap 1121 itself forms a central hole HC. The fifth strap 1122 connects the fourth strap 1121 to form a second accommodation hole H2*a*, while the sixth strap 1123 connects the fourth strap 1121 to form another second accommodation hole H2*b*.

The fixation structure 12, connected with the elastic main body 11 for defining therebetween a penetration space S (labeled in FIG. 3), includes a central fixed portion 121, a seventh strap 122, an eighth strap 123, a ninth strap 124 and a tenth strap 125. The central fixed portion 121, the seventh strap 122 and the eighth strap 123 are together to form a through hole Ha. The central fixed portion 121, the ninth strap 124 and the tenth strap 125 are together to form another through hole Hb. The through holes Ha, Hb can be used for ventilation, such that higher temperatures to user's right hand HR (labeled in FIG. 5) or left hand HL (labeled in FIG. 6) can be avoided.

The central connected structure 13, connecting the elastic main body 11 and the fixation structure 12, is a circular structure. In this embodiment, the central connected structure 13 integrates both the elastic main body 11 and the fixation structure 12 as a unique piece. In particular, all the aforesaid straps are extended outward from the central connected structure 13.

In addition, in this embodiment, the strap-type elastic phone-hand connector 1, defined with a reference center line X (labeled in FIG. 4), is structurally symmetrical with respect to the reference center line X.

Figure 3:
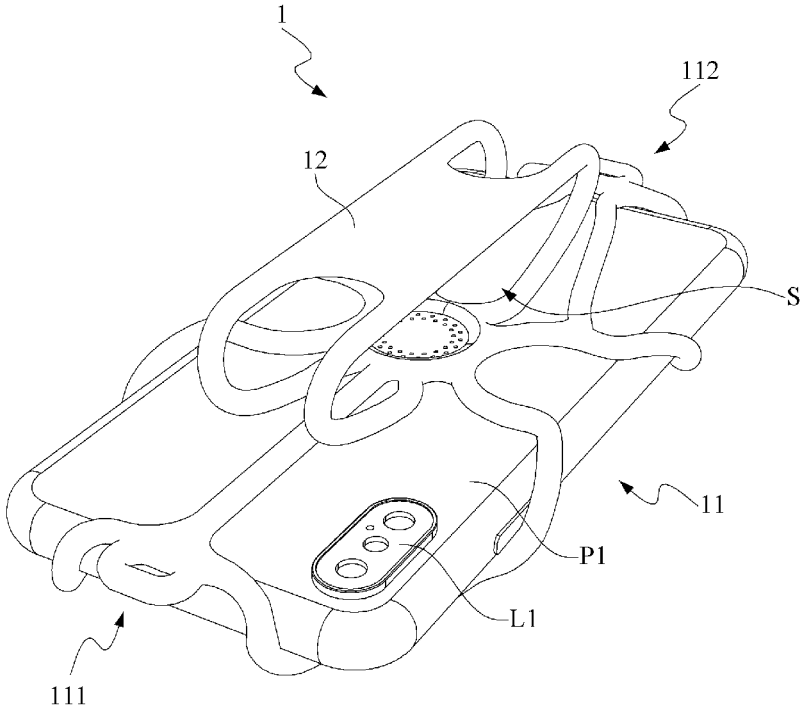
FIG. 3 is a schematic perspective view showing that the first embodiment of the strap-type elastic phone-hand connector fixedly wraps a corner-lens-type mobile device.
Figure 4:
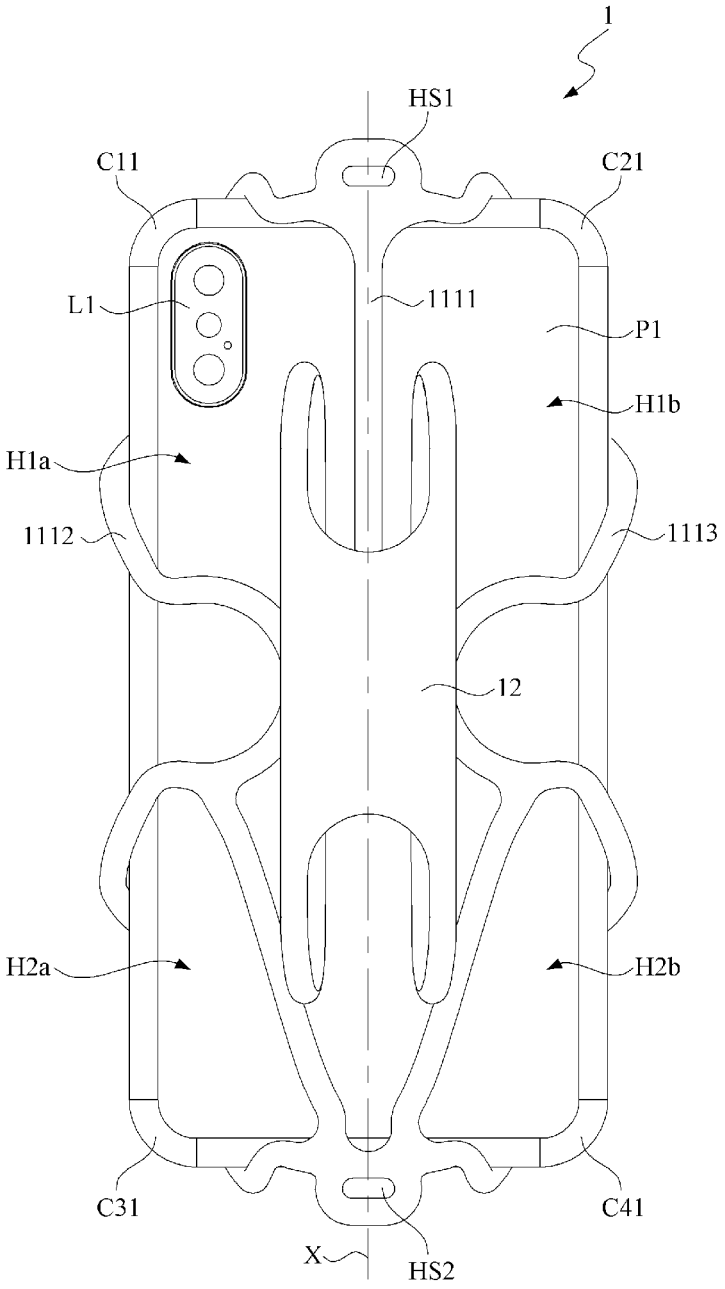
FIG. 4 shows schematically another view of FIG. 3.
Figure 5:
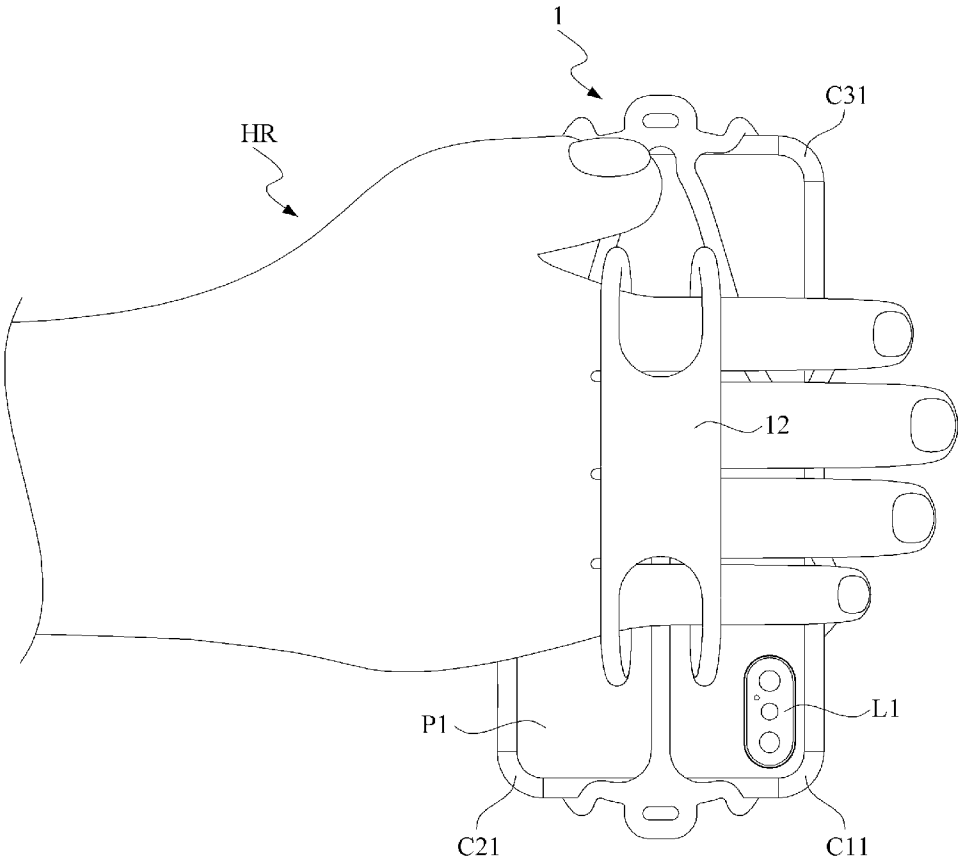
FIG. 5 is a schematic view showing that the first embodiment of the strap-type elastic phone-hand connector of FIG. 3 is worn by a user.
Figure 6:
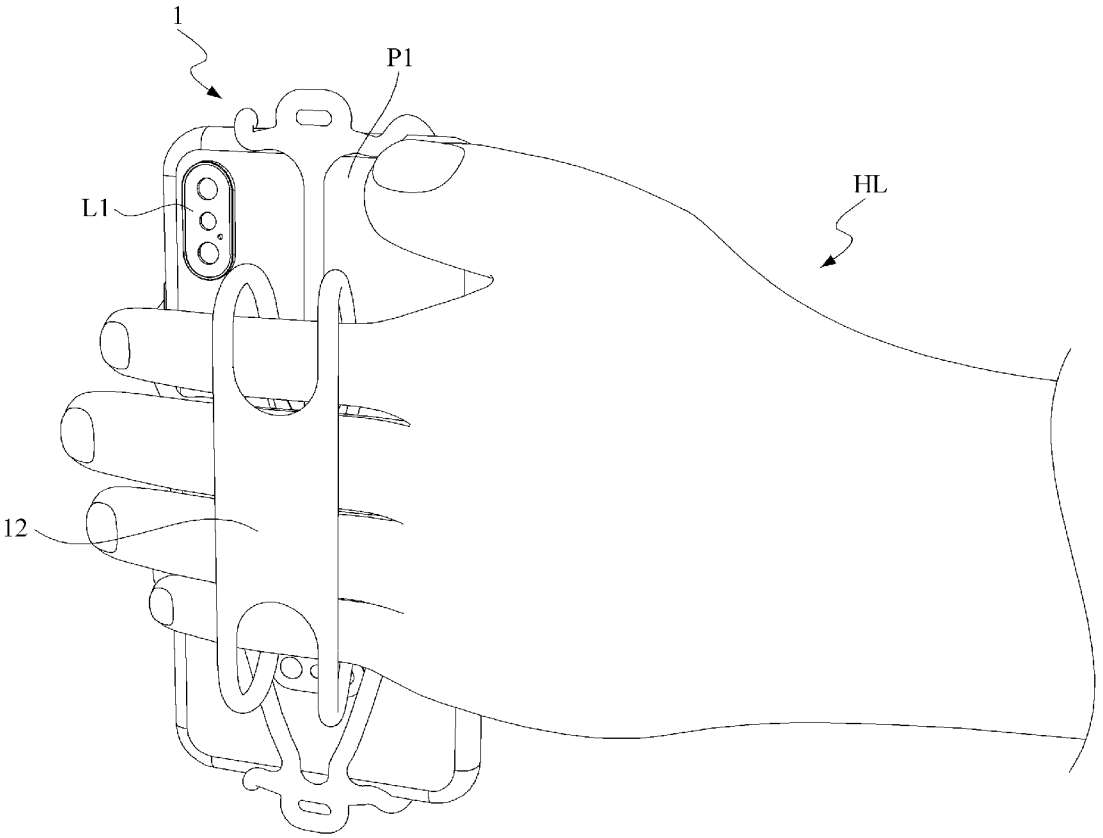
FIG. 6 is a schematic view showing that the first embodiment of the strap-type elastic phone-hand connector of FIG. 3 is worn by another user.
Figure 7:
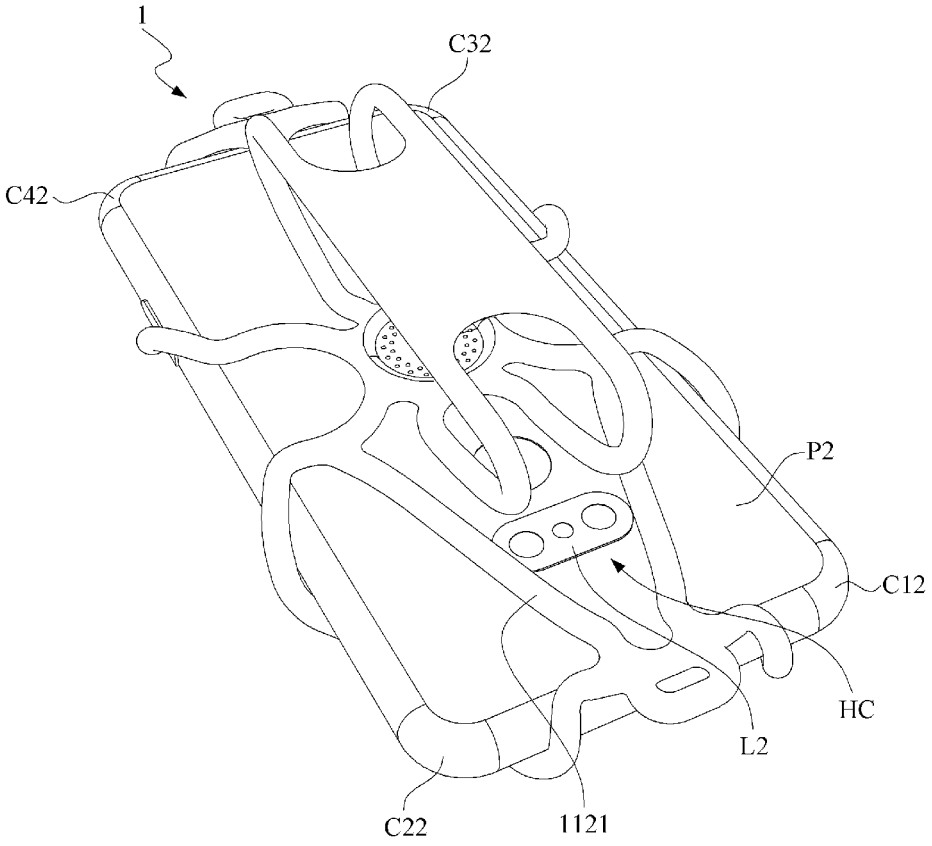
FIG. 7 is a schematic perspective view showing that the first embodiment of the strap-type elastic phone-hand connector fixedly wraps a central-lens-type mobile device.
Figure 8:
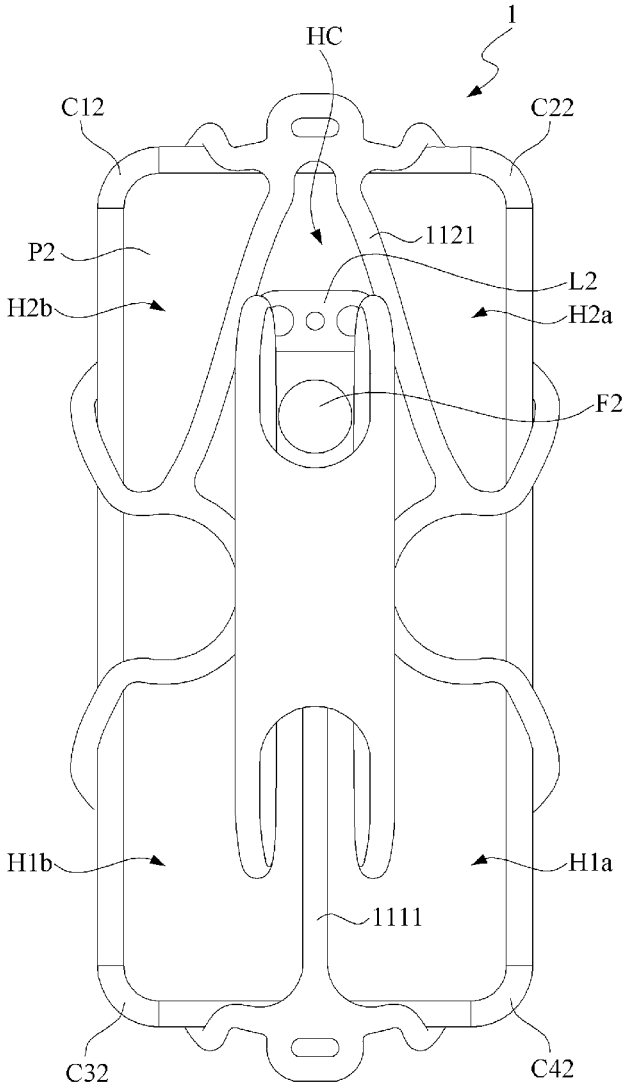
FIG. 8 shows schematically another view of FIG. 7.
Figure 9:
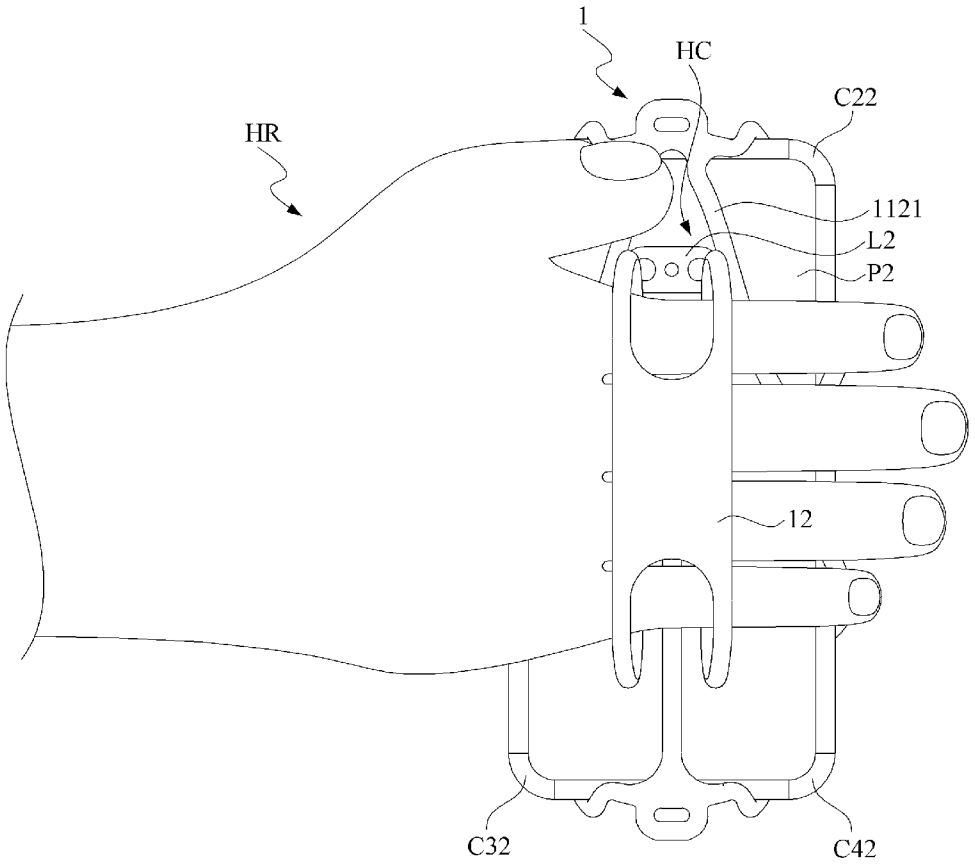
FIG. 9 is a schematic view showing that the first embodiment of the strap-type elastic phone-hand connector of FIG. 7 is worn by a user.
Figure 10:
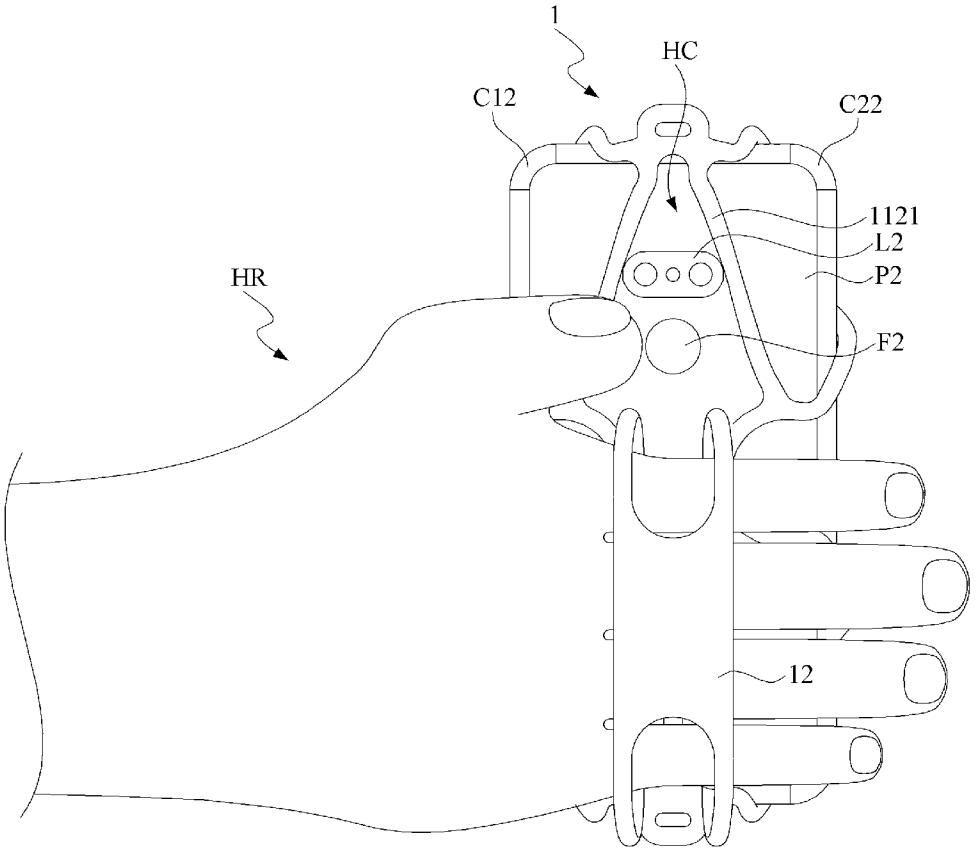
FIG. 10 shows schematically another view of FIG. 9.

Then, refer together to FIG. 1 through FIG. 10; where FIG. 3 is a schematic perspective view showing that the first embodiment of the strap-type elastic phone-hand connector fixedly wraps a corner-lens-type mobile device, FIG. 4 shows schematically another view of FIG. 3, FIG. 5 is a schematic view showing that the first embodiment of the strap-type elastic phone-hand connector of FIG. 3 is worn by a user, FIG. 6 is a schematic view showing that the first embodiment of the strap-type elastic phone-hand connector of FIG. 3 is worn by another user, FIG. 7 is a schematic perspective view showing that the first embodiment of the strap-type elastic phone-hand connector fixedly wraps a central-lens-type mobile device, FIG. 8 shows schematically another view of FIG. 7, FIG. 9 is a schematic view showing that the first embodiment of the strap-type elastic phone-hand connector of FIG. 7 is worn by a user, and FIG. 10 shows schematically another view of FIG. 9. As shown, the strap-type elastic phone-hand connector 1 is selectively used for fixedly wrapping a corner-lens-type mobile device P1 or a central-lens-type mobile device P2.

In the case that the strap-type elastic phone-hand connector 1 is utilized to fixedly wrap the corner-lens-type mobile device P1 as shown from FIG. 3 to FIG. 6, the first accommodation holes H1*a*, H1*b* and the second accommodation holes H2*a*, H2*b* formed by the elastic main body 11 would hook (by sleeving) four corresponding corner portions C11, C21, C31, C41 of the corner-lens-type mobile device P1, such that the corner-lens-type mobile device P1 can be fixedly wrapped by having a corner lens assembly L1 thereof to expose through the first accommodation hole H1*a*.

At least part of user's right hand HR can penetrate through the penetration space S of the fixation structure 12 so as to hold the fixation structure 12 or the corner-lens-type mobile device P1. Thereupon, the risk of slipping the corner-lens-type mobile device P1 can be avoided. Practically, the user can have his/her fingers to penetrate through the penetration space S, or his/her palm to penetrate through the penetration space S.

The user can also have his/her left hand HL to penetrate through the penetration space S. It shall be explained that the corner-lens-type mobile device P1 can be fixed by having the corner lens assembly L1 to face downward as shown in FIG. 5, or by having the corner lens assembly L1 to face upward as shown in FIG. 6.

In addition, the corner-lens-type mobile device P1 may have its corner lens assembly L1 located at another side. At this time, the corner lens assembly L1 would be then exposed through the first accommodation hole H1*b*. Thus, no matter what side of the corner-lens-type mobile device P1 is to locate the corner lens assembly L1, the first accommodation holes H1*a*, H1*b* would not allow the strap-type elastic phone-hand connector 1 to shade the corner lens assembly L1.

In this embodiment, the first strap unit 111 further forms a first object-connecting hole HS1, and the second strap unit 112 further forms a second object-connecting hole HS2. The first object-connecting hole HS1 and the second object-connecting hole HS2 can allow other ropes, straps or other foreign objects to pass through for serving some other purposes such as to be worn through the neck or to be hung at the hand or arm.

In the case that the strap-type elastic phone-hand connector 1 is utilized to fixedly wrap the central-lens-type mobile device P2 as shown from FIG. 7 to FIG. 10, the second accommodation holes H2*b*, H2*a* and the first accommodation holes H1*b*, H1*a* formed by the elastic main body 11 would hook, by sleeving, four corresponding corner portions C12, C22, C32, C42 of the central-lens-type mobile device P2, such that the central-lens-type mobile device P2 can be fixedly wrapped by having a central lens assembly L2 thereof to expose right through the central hole HC. Thereupon, the central hole HC would allow the central lens assembly L2 of the strap-type elastic phone-hand connector 1 to have a clear field of vision.

In this exemplary example, the strap-type elastic phone-hand connector 1 fixedly wrapping the central-lens-type mobile device P2 can be seen as an upside-down version of the previous strap-type elastic phone-hand connector 1 fixedly wrapping the corner-lens-type mobile device P1.

At least part of user's right hand HR can penetrate through the penetration space S of the fixation structure 12 so as to hold the fixation structure 12 or the central-lens-type mobile device P2. Thereupon, the risk of slipping the central-lens-type mobile device P2 can be avoided. Practically, the user can have his/her fingers to penetrate through the penetration space S, or his/her palm to penetrate through the penetration space S. Similarly, the user can have his/her left hand HL to penetrate the penetration space S.

If the central-lens-type mobile device P2 includes a fingerprint touch button F2, the elastic fixation structure 12 can be moved downward so as not to block the fingerprint touch button F2.

As described above, it is understood that the strap-type elastic phone-hand connector 1 can be commonly used to fixedly wrap different types of the corner-lens-type mobile device P1 or the central-lens-type mobile device P2, particularly without shading the corner lens assembly L1 or the central lens assembly L2. Thus, while in exercise, the smartphone can be directly used to capture instant images for recording the sport details such as types and weights of loading in a weight training. In addition, in the case that the central-lens-type mobile device P2 is furnished with the fingerprint touch button F2, then the fixation structure 12 can be elastically shifted to prevent from shading the fingerprint touch button F2.

The first accommodation holes H1*a*, H1*b* and the second accommodation holes H2*a*, H2*b* formed in the strap-type elastic phone-hand connector 1 can be used for fixedly wrapping the corner-lens-type mobile device P1 or the central-lens-type mobile device P2, and from which the risk of slipping the corner-lens-type mobile device P1 or the central-lens-type mobile device P2 can be avoided. In addition, by providing slim spacing between the central connected structure 13 and either the corner-lens-type mobile device P1 or the central-lens-type mobile device P2, a card such as a name card or a commercial card, can be contained by having the central connected structure 13 to fixedly attach the card onto the corner-lens-type mobile device P1 or the central-lens-type mobile device P2. Further, the first strap unit 111 or the second strap unit 112 can also help to anchor the card from being dropped off.

Figure 11:
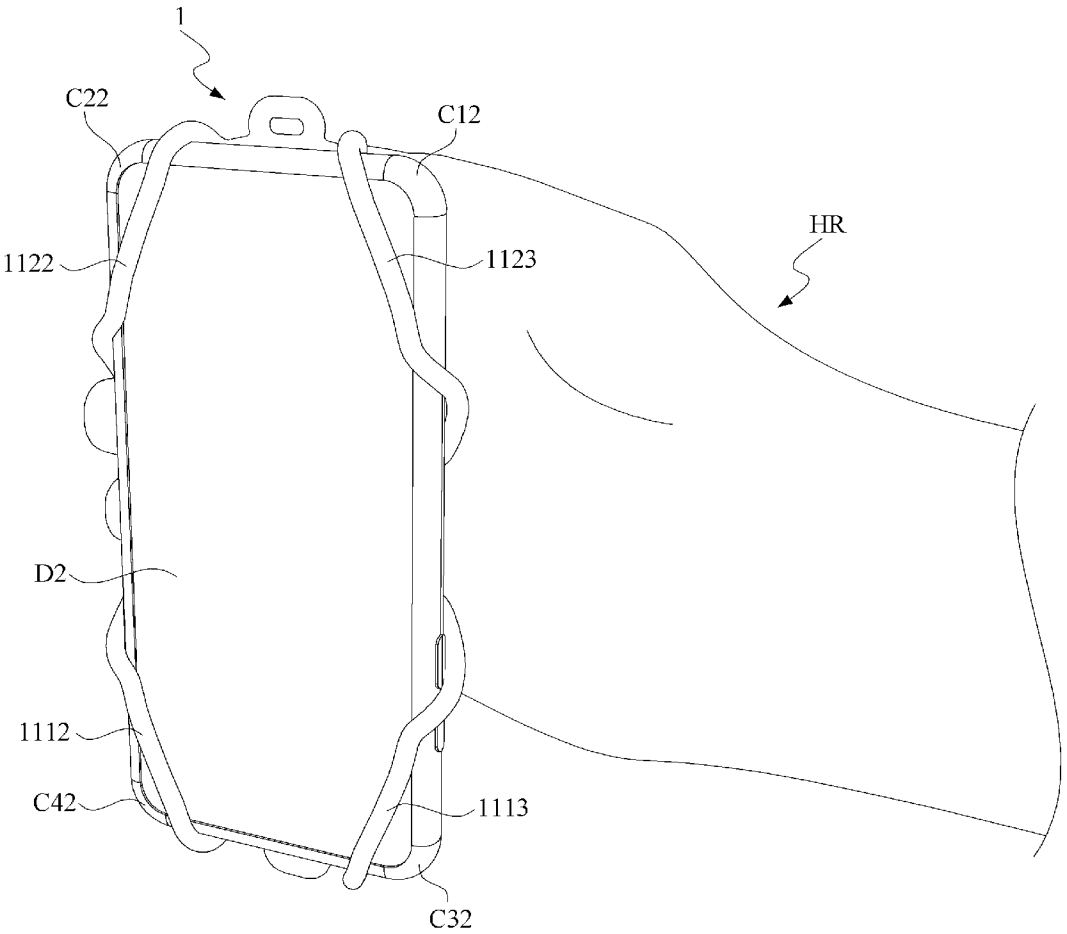
FIG. 11 shows schematically a further view of FIG. 9.

Referring to FIG. 11, a front view of FIG. 9 is schematically shown. Here, the strap-type elastic phone-hand connector 1 wraps fixedly the central-lens-type mobile device P2 including a display screen D2.

As shown, the fifth strap 1122, the sixth strap 1123, the second strap 1112 and the third strap 1113 would extend over the display screen D2 of the central-lens-type mobile device P2. Since the fifth strap 1122, the sixth strap 1123, the second strap 1112 and the third strap 1113 can only occupy an extreme small area of the display screen D2, thus displaying on the display screen D2 won't be downgraded.

Figure 12:
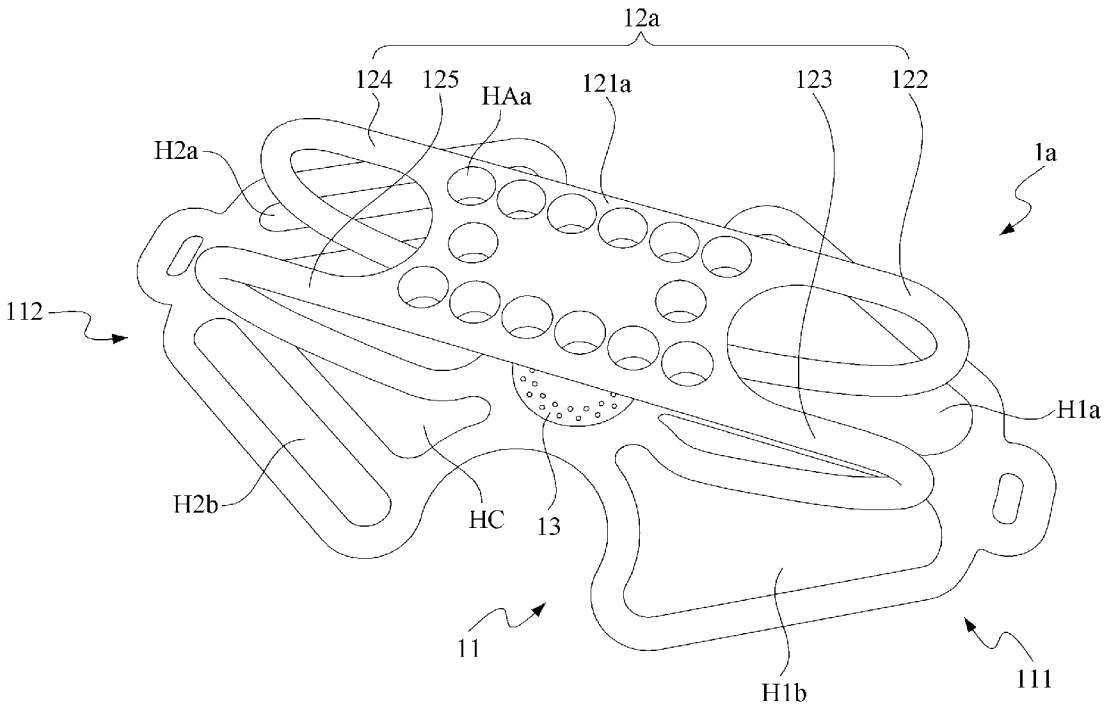
FIG. 12 is a schematic perspective view of a second embodiment of the strap-type elastic phone-hand connector in accordance with the present invention.

Finally, referring to FIG. 12, a schematic perspective view of a second embodiment of the strap-type elastic phone-hand connector in accordance with the present invention is shown. In this embodiment, a strap-type elastic phone-hand connector 1*a* includes an elastic main body 11, a fixation structure 12*a* and a central connected structure 13.

It shall be explained that a difference between this strap-type elastic phone-hand connector 1*a* and the previous strap-type elastic phone-hand connector 1 in the first embodiment is the fixation structure 12*a*. Except for that, the elastic main body 11, the first strap unit 111, the second strap unit 112, the first accommodation holes H1*a*, H1*b*, the second accommodation holes H2*a*, H2*b*, the central hole HC and the central connected structure 13 of this embodiment are resembled to those of the aforesaid first embodiment, and thus details thereabout would be omitted herein.

Further in detail, it is briefed that the difference between the fixation structure 12*a* of this embodiment and the fixation structure 12 of the first embodiment is the central fixed portion 121*a*, but having the seventh strap 122, the eighth strap 123, the ninth strap 124 and the tenth strap 125 of this embodiment to be the same as those of the first embodiment. In this embodiment, the central fixed portion 121*a* is further furnished with at least one air vent (14 shown in the figure, with one of them labeled as HAa).

In comparison with the seventh strap 122, the eighth strap 123, the ninth strap 124 and the tenth strap 125, the central fixed portion 121*a* makes a broader area to contact user's hand (such as the right hand HR or the left hand HL in the first embodiment). Thus, in order not to have user's hand to feel stuffy or even sweating, the at least one air vent HAa provided to the central fixed portion 121*a* can promote local ventilation and thereby reduce further the sultry feeling at user's hand.

In summary, the strap-type elastic phone-hand connector provided by this invention utilizes the first strap unit and the second strap unit to fixedly wrap the central-lens-type mobile device or the corner-lens-type mobile device by relevantly skipping off the corner lens assembly or the central lens assembly. In comparison with the prior art, the connector of this invention can be commonly applied to different kinds of smartphone, without shading the lens assembly, but with the minimum risk in slipping the smartphone. In addition, the strap-type elastic phone-hand connector further introduces the through holes or the air vents for ventilation, such that possible sultry feeling at user's hand can be substantially reduced.

While the present invention has been particularly shown and described with reference to a preferred embodiment, it will be understood by those skilled in the art that various changes in form and detail may be without departing from the spirit and scope of the present invention.

What is claimed is:

1. A strap-type elastic phone-hand connector, applied for selectively and fixedly wrapping a central-lens-type mobile device or a corner-lens-type mobile device, comprising:

an elastic main body, used for elastically and fixedly wrapping the central-lens-type mobile device or the corner-lens-type mobile device, including:

a first strap unit, located at a first side of the elastic main body, forming thereof two neighboring first accommodation holes; and a second strap unit, connected with the first strap unit, located at a second side of the elastic main body by opposing to the first side, forming a central hole and two opposing second accommodation holes with respect to the central hole; and a fixation structure, connected with the elastic main body, used for defining a penetration space thereunder for allowing at least part of a hand to penetrate therethrough;

wherein, when the strap-type elastic phone-hand connector is utilized to fixedly wrap the central-lens-type mobile device, a central lens assembly of the central-lens-type mobile device is exposed through the central hole, and the two first accommodation holes and the two second accommodation holes hook four corner portion of the central-lens-type mobile device;

wherein, when the strap-type elastic phone-hand connector is utilized to fixedly wrap the corner-lens-type mobile device, a corner lens assembly of the corner-lens-type mobile device is exposed to one of the two first accommodation holes, and the two first accommodation holes and the two second accommodation holes hook four corner portions of the corner-lens-type mobile device.

2. The strap-type elastic phone-hand connector of claim 1, wherein the first strap unit includes:

a first strap;

a second strap, connected with the first strap to form one of the two first accommodation holes; and a third strap, connected with the first strap to form another one of the two first accommodation holes.

3. The strap-type elastic phone-hand connector of claim 1, wherein the second strap unit includes:

a fourth strap, forming the central hole;

a fifth strap, connected with the fourth strap to form one of the two second accommodation hole; and a sixth strap, connected with the fourth strap to form another one of the two second accommodation holes.

4. The strap-type elastic phone-hand connector of claim 1, wherein the fixation structure includes:

a central fixed portion;

a seventh strap, connected with the central fixed portion and the first strap unit, located at the first side;

an eighth strap, connected with the central fixed portion and the first strap unit, located at the first side;

a ninth strap, connected with the central fixed portion and the second strap unit, located at the second side; and a tenth strap, connected with the central fixed portion and the second strap unit, located at the second side.

5. The strap-type elastic phone-hand connector of claim 4, wherein the central fixed portion is furnished with at least one air vent.

6. The strap-type elastic phone-hand connector of claim 1, wherein the fixation structure is furnished with at least one through hole.

7. The strap-type elastic phone-hand connector of claim 1, further including a central connected structure, the central connected structure being connected with the elastic main body and the fixation structure.

8. The strap-type elastic phone-hand connector of claim 1, being a symmetrical structure with respect to a reference center line.

9. The strap-type elastic phone-hand connector of claim 1, wherein the elastic main body is integrated with the fixation structure as a unique piece.

10. The strap-type elastic phone-hand connector of claim 1, wherein the first strap unit further forms a first object-connecting hole.

11. The strap-type elastic phone-hand connector of claim 1, wherein the second strap unit further forms a second object-connecting hole.

* * * * *